US010242634B2

(12) United States Patent
Sang et al.

(10) Patent No.: US 10,242,634 B2
(45) Date of Patent: Mar. 26, 2019

(54) DISPLAY DEVICE

(71) Applicant: LG Display Co., Ltd., Seoul (KR)

(72) Inventors: Wookyu Sang, Gyeonggi-do (KR); Sangjin Nam, Chungcheongnam-do (KR); Ooksang Yoo, Daejeon (KR); Seungjin Yoo, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 51 days.

(21) Appl. No.: 14/983,708

(22) Filed: Dec. 30, 2015

(65) Prior Publication Data

US 2016/0322008 A1 Nov. 3, 2016

(30) Foreign Application Priority Data

Apr. 30, 2015 (KR) ..... 10-2015-0061857

(51) Int. Cl.
*G09G 3/36* (2006.01)
*G09G 3/3275* (2016.01)

(52) U.S. Cl.
CPC ..... *G09G 3/3607* (2013.01); *G09G 3/3275* (2013.01); *G09G 3/3688* (2013.01); *G09G 3/3614* (2013.01); *G09G 2300/0426* (2013.01); *G09G 2300/0452* (2013.01); *G09G 2310/027* (2013.01); *G09G 2310/0297* (2013.01); *G09G 2310/08* (2013.01); *G09G 2320/0666* (2013.01); *G09G 2330/021* (2013.01)

(58) Field of Classification Search
None
See application file for complete search history.

(56) References Cited

U.S. PATENT DOCUMENTS

2009/0195495 A1* 8/2009 Hsu ..... G09G 3/3607 345/104
2010/0128160 A1 5/2010 Maru et al.
2010/0289786 A1* 11/2010 Tanaka ..... G09G 3/3648 345/209
2014/0111406 A1 4/2014 Wang et al.
2014/0160172 A1* 6/2014 Lee ..... G09G 3/3607 345/690
2016/0189640 A1* 6/2016 Guo ..... G09G 3/3688 345/694

FOREIGN PATENT DOCUMENTS

CN 104505038 A 4/2015

OTHER PUBLICATIONS

Extended European Search Report dated Aug. 30, 2016 for the corresponding European patent application No. 15195842.8.

* cited by examiner

*Primary Examiner* — Stephen T. Reed
(74) *Attorney, Agent, or Firm* — Morgan, Lewis & Bockius LLP

(57) ABSTRACT

A display device is disclosed. A display panel includes a plurality of subpixels of a plurality of colors arranged in a matrix form, and a plurality of gate lines and data lines respectively connected to the subpixels. A data driver is configured to supply data voltages to the subpixels through a plurality of source channels and the data lines. A switch circuit is configured to connect one of the source channels selectively to one of the data lines during a first scan period in one horizontal period and to a different one of the data lines during a second scan period in the one horizontal period. The data driver is configured to supply data voltages of one color to the one of the source channels during both the first scan period and the second scan period in the one horizontal period.

21 Claims, 10 Drawing Sheets

DISPLAY DEVICE

This application claims the benefit of Korean Patent Application No. 10-2015-0061857 filed on Apr. 30, 2015, the entire contents of which are incorporated herein by reference for all purposes as if fully set forth herein.

BACKGROUND OF THE INVENTION

Field of the Invention

The present invention relates to a display device.

Discussion of the Related Art

Examples of a flat panel display include a liquid crystal display (LCD), a field emission display (FED), a plasma display panel (PDP), and an organic light emitting diode (OLED) display. In a flat panel display, data lines and gate lines are typically arranged to cross each other, and a pixel is defined by each crossing of the data lines and the gate lines. A plurality of pixels are formed on a display panel of the flat panel display in a matrix form. The flat panel display supplies a video data voltage to the data lines and sequentially supplies a gate pulse to the gate lines, thereby driving the pixels. The flat panel display supplies the video data voltage to the pixels of a gate line, to which the gate pulse is supplied, and sequentially scans all of the gate lines with the gate pulse, thereby displaying video data.

The data voltage supplied to a data line is generated in a data driver, and the data driver outputs the data voltage through a source channel connected to the data line. Recently, a structure, in which a plurality of data lines are connected to one source channel, and the source channel and the data lines are selectively connected using a multiplexer (MUX), is used to reduce the number of source channels. The interval between MUX signals decreases as the resolution and the size of the display panel increase. Further, because the MUX signals are delayed in a display panel of a high resolution, adjacent MUX signals may overlap each other. When the MUX signals overlap each other, the data voltage output from the source channel may be supplied to an unintended data line. Hence, the display quality of the flat panel display may be reduced.

SUMMARY OF THE INVENTION

Accordingly, the present invention is directed to a display device that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a display device includes: a display panel including a plurality of subpixels of a plurality of colors arranged in a matrix form, and a plurality of gate lines and data lines respectively connected to the subpixels; a data driver configured to supply data voltages to the subpixels through a plurality of source channels and the data lines; and a switch circuit configured to connect one of the source channels selectively to one of the data lines during a first scan period in one horizontal period and to a different one of the data lines during a second scan period in the one horizontal period, wherein the data driver is configured to supply data voltages of one color to the one of the source channels during both the first scan period and the second scan period in the one horizontal period.

In another aspect, a display device includes: a first subpixel group including a first subpixel of a first color, a second subpixel of a second color, and a third subpixel of a third color; a second subpixel group including a fourth subpixel of the first color, a fifth subpixel of the second color, and a sixth subpixel of the third color; a plurality of data lines and a plurality of gate lines, the data lines including at least first to sixth data lines respectively connected to the first to the sixth subpixels, and the gate lines including at least a first gate line connected to each of the first to the sixth subpixels; a data driver configured to supply data voltages respectively to a plurality of source channels including at least a first source channel, a second source channel, and a third source channel; and a switch circuit configured to selectively connect the first source channel at least to the first data line and the fourth data line, the second source channel at least to the second data line and the fifth data line, and the third source channel at least to the third data line and the sixth data line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EXAMPLE EMBODIMENTS

Reference will now be made in detail to embodiments, examples of which are illustrated in the accompanying drawings. Wherever possible, the same reference numbers will be used throughout the drawings to refer to the same or like parts.

Figure 1:
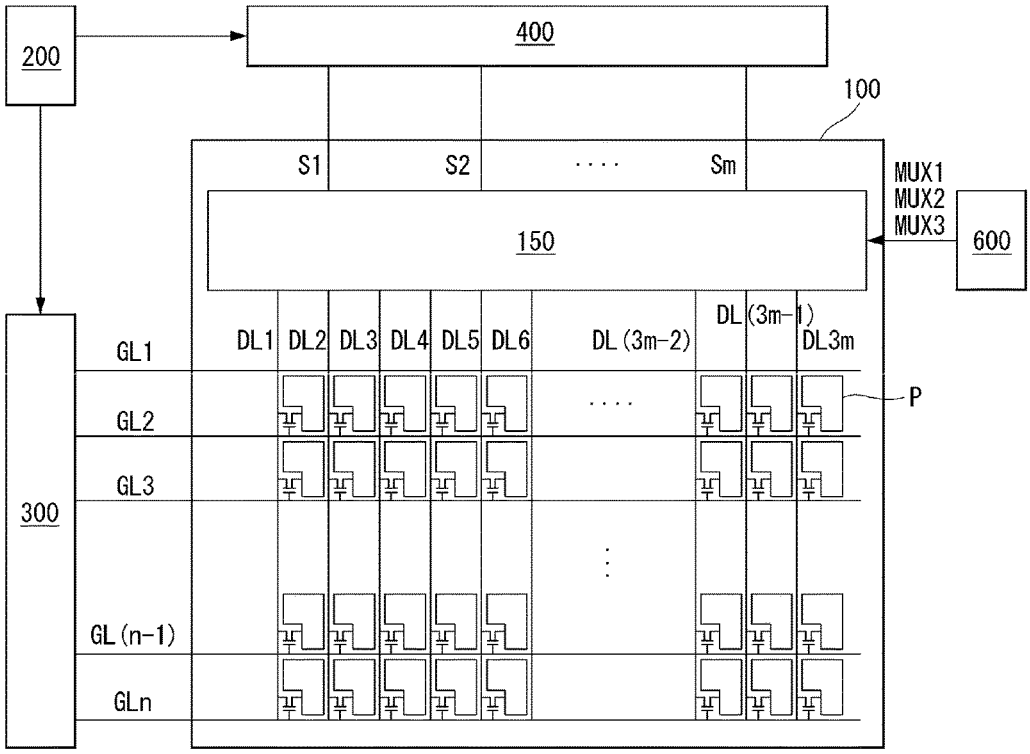
FIG. 1 illustrates a display device according to an example embodiment of the invention.

FIG. 1 illustrates a display device according to an example embodiment.

As shown in FIG. 1, the display device according to the example embodiment includes a display panel 100, a timing controller 200, a gate driver 300, a data driver 400, and a multiplexer (MUX) controller 600.

Figure 2:
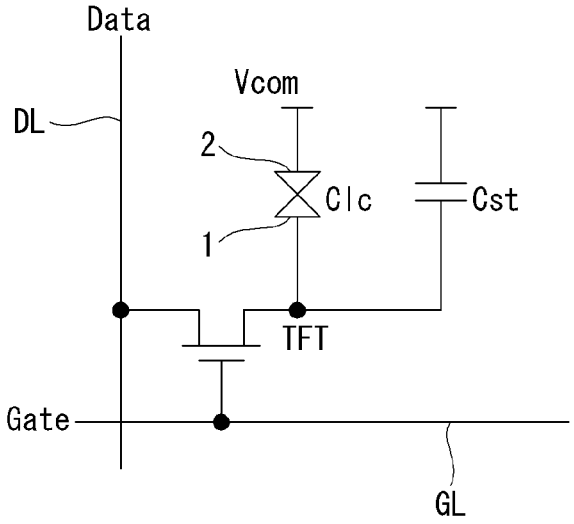
FIG. 2 shows an example of a pixel shown in FIG. 1.

The display panel 100 includes a pixel array, in which pixels are arranged in a matrix form and which displays input image data. As shown in FIG. 2, the pixel array may include a thin film transistor (TFT) array formed on a lower substrate (not shown), a color filter array formed on an upper substrate (not shown), and liquid crystal cells Clc formed between the lower substrate and the upper substrate. The TFT array may include data lines DL, gate lines GL crossing the data lines DL, thin film transistors (TFTs) respectively formed at the crossings of the data lines DL and the gate lines GL, pixel electrodes 1 connected to the TFTs, storage capacitors Cst, and the like. The color filter array includes black matrixes and color filters. A common electrode 2 may be formed on the lower substrate or the upper substrate. Each liquid crystal cell Clc is driven by an electric field between the pixel electrode 1, to which a data voltage is supplied, and the common electrode 2, to which a common voltage Vcom is supplied.

The timing controller 200 may receive digital video data RGB and timing signals, such as a vertical sync signal Vsync, a horizontal sync signal Hsync, a data enable signal DE, and a main clock CLK, from an external host. The timing controller 200 may transmit the digital video data RGB to the data driver 400. The timing controller 200 may generate a source timing control signal for controlling operation timing of the data driver 400 and a gate timing control signal for controlling operation timing of the gate driver 300 using the timing signals Vsync, Hsync, DE, and CLK.

The gate driver 300 outputs a gate pulse Gout using the gate timing control signal. The gate timing control signal may include a gate start pulse GSP, a gate shift clock GSC, and a gate output enable signal GOE. The gate start pulse GSP indicates a start gate line, to which the gate driver 300 outputs a first gate pulse Gout. The gate shift clock GSC is a clock for shifting the gate start pulse GSP. The gate output enable signal GOE sets an output period of the gate pulse Gout.

Figure 3:
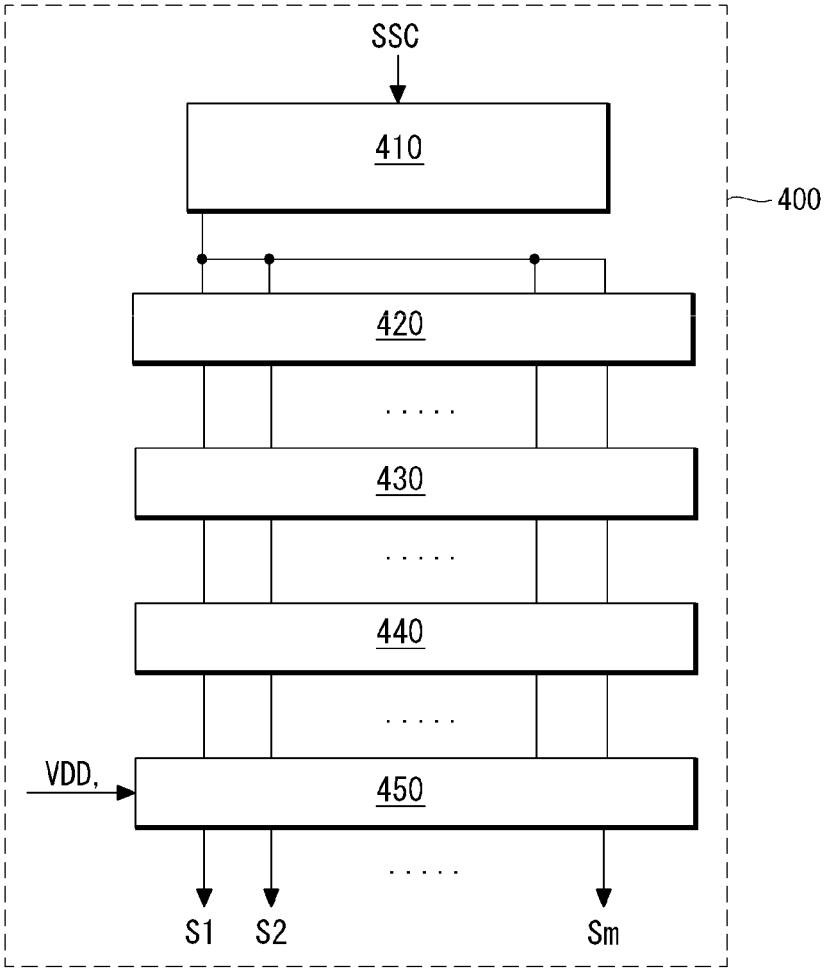
FIG. 3 shows an example of a data driver.

As shown in FIG. 3, the data driver 400 may include a register 410, a first latch 420, a second latch 430, a digital-to-analog converter (DAC) 440, and an output unit 450. The register 410 samples an RGB digital video data bit of an input image in response to data control signals SSC received from the timing controller 200 and supplies it to the first latch 420. The first latch 420 samples and latches the RGB digital video data bit in response to the clock sequentially received from the register 410. Then, the first latch 420 simultaneously outputs the latched digital video data to the second latch 430. The second latch 430 latches the digital video data received from the first latch 420 and simultaneously outputs the latched data in response to a source output enable signal SOE. The DAC 440 converts the digital video data input from the second latch 430 into a gamma compensation voltage and generates an analog video data voltage. The output unit 450 supplies the analog data voltage output from the DAC 440 to the source channels S during a low logic period of the source output enable signal SOE. The output unit 450 may be implemented as an output buffer for outputting the data voltage using a driving voltage received through a low potential voltage and a high potential input terminal.

Figure 4:
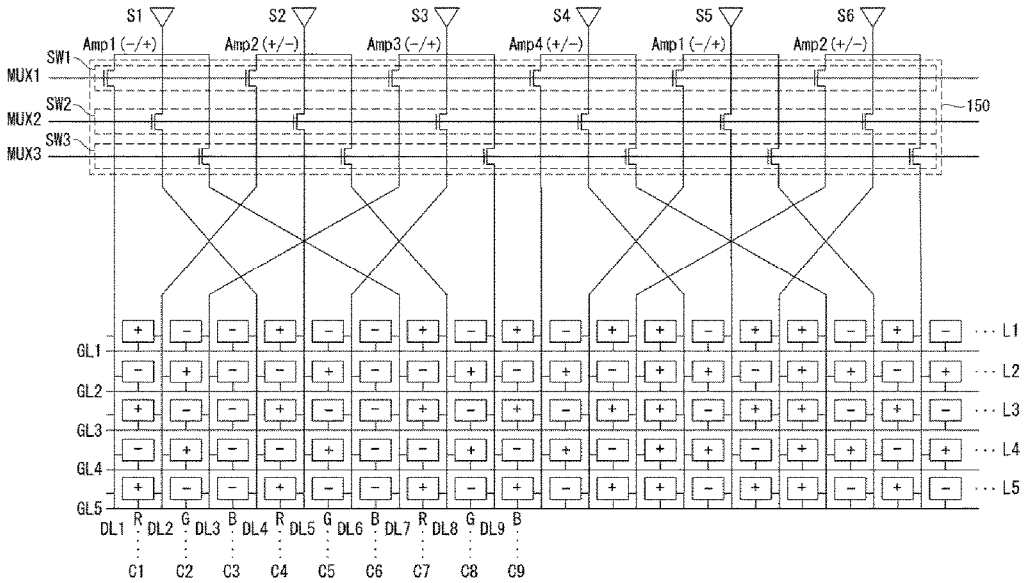
FIG. 4 illustrates a structure of a switching unit according to a first example embodiment of the invention.
Figure 5:
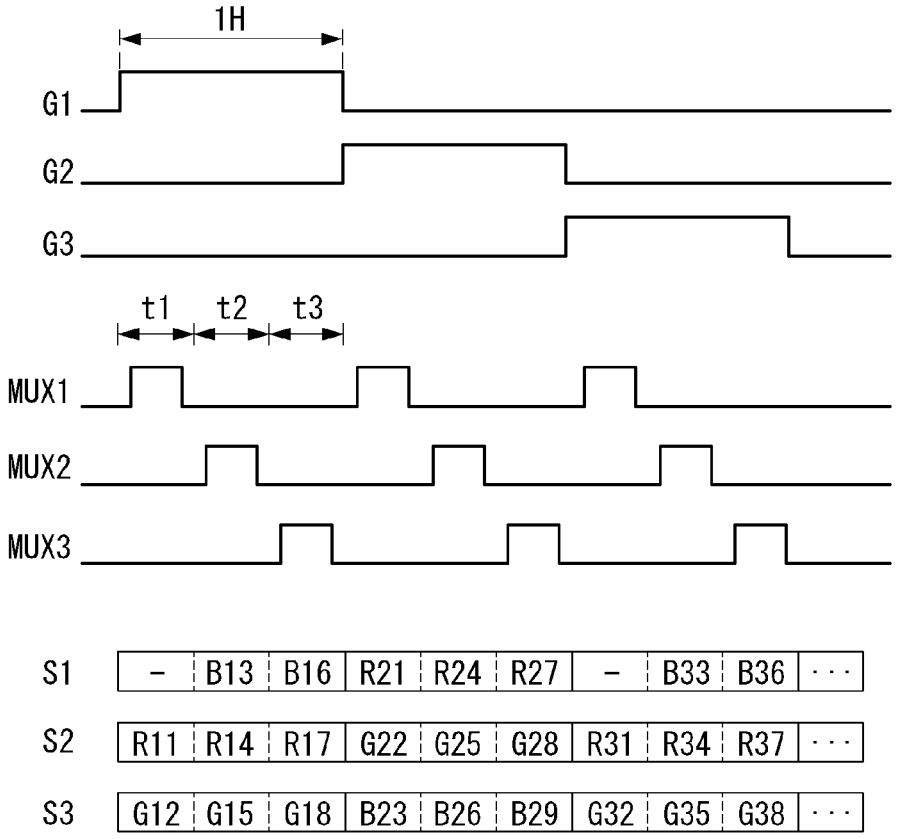
FIG. 5 illustrates a gate pulse and a MUX signal according to a first example embodiment of the invention.

FIG. 4 illustrates a switching unit and a pixel array according to a first example embodiment. FIG. 5 illustrates timing of a gate pulse and MUX signals according to the first example embodiment.

A display device according to the first example embodiment is described in detail below.

The display panel 100 includes red subpixels R, green subpixels G, and blue subpixels B arranged along column lines. The red subpixels R are arranged along a (3m−2)-th column line C(3m−2), where m is a natural number. The green subpixels G are arranged along a (3m−1)-th column line C(3m−1), and the blue subpixels B are arranged along a (3m)-th column line C(3m). For example, the red subpixels R are arranged along a first column line C1, a fourth column line C4, and a seventh column line C7. The green subpixels G are arranged along a second column line C2, a fifth column line C5, and an eighth column line C8. The blue subpixels B are arranged along a third column line C3, a sixth column line C6, and a ninth column line C9.

The first to the 3m-th data lines DL1 to DL3*m* are disposed along the direction of the first to the 3m-th column lines C1 to C3*m*.

The first to the 3m-th data lines DL1 to DL3*m* receive the data voltage through source channels S1 to Sm used to output the data voltage from the data driver 400. Each of the source channels S1 to Sm is connected to three corresponding data lines. For example, a (3i−2)-th source channel is connected to a (3i−2)-th data line, a (3(i+1)−2)-th data line, and a (3(i+2)−2)-th data line, where "i" is a natural number satisfying a condition of "3i=m". A (3i−1)-th source channel may be connected to a (3i−1)-th data line, a (3(i+1)−1)-th data line, and a (3(i+2)−1)-th data line. A (3i)-th source channel may be connected to a (3i)-th data line, a (3(i+1))-th data line, and a (3(i+2))-th data line. For example, the first source channel S1 may be connected to the first data line DL1, the fourth data line DL4, and the seventh data line DL7. The second source channel S2 may be connected to the second data line DL2, the fifth data line DL5, and the eighth data line DL8. The third source channel S3 may be connected to the third data line DL3, the sixth data line DL6, and the ninth data line DL9.

The gate lines GL may include the first to the n-th gate lines GL1 to GLn for supplying the gate pulse during the first to the n-th horizontal periods t1 to tn, where n is a natural number. The gate driver 300 may supply the gate pulse to the first gate line GL1 during the first horizontal period G1, to the second gate line GL2 during the second horizontal period G2, to the third gate line GL3 during the third horizontal period G3, and so on.

A switching unit 150 according to the first example embodiment includes the first to the third switching elements SW1 to SW3 so as to switch an output of the source channels. Each of the first to the third switching elements SW1 to SW3 includes switching parts corresponding to the number of source channels. The first switching element SW1 operates in response to a first MUX signal MUX1, the second switching element SW2 operates in response to a second MUX signal MUX2, and the third switching element SW3 operates in response to a third MUX signal MUX3.

The MUX controller 600 outputs the first MUX signal MUX1 during the first scan period t1, outputs the second MUX signal MUX2 during the second scan period t2, and outputs the third MUX signal MUX3 during the third scan period t3.

During the first scan period t1, the first switching element SW1 connects the first source channel S1 to the first data line DL1, connects the second source channel S2 to the second data line DL2, and connects the third source channel S3 to the third data line DL3, in response to the first MUX signal MUX1.

During the second scan period t2, the second switching element SW2 connects the first source channel S1 to the fourth data line DL4, connects the second source channel S2 to the fifth data line DL5, and connects the third source channel S3 to the sixth data line DL6, in response to the second MUX signal MUX2.

During the third scan period t3, the third switching element SW3 connects the first source channel S1 to the seventh data line DL7, connects the second source channel S2 to the eighth data line DL8, and connects the third source channel S3 to the ninth data line DL9, in response to the third MUX signal MUX3.

During one horizontal period, the data driver 400 supplies the data voltage of the same color to each source channel. In FIG. 5, the data voltage output through each source channel indicates a color and a position of the subpixel receiving the data voltage. Namely, "Rab" indicates the data voltage supplied to a red subpixel positioned on an a-th horizontal line and a b-th column line. For example, "B16", which the first source channel S1 outputs during the third scan period t3 of one horizontal period 1H, indicates the data voltage supplied to a blue subpixel positioned on a first horizontal line L1 and the sixth column line C6.

During one horizontal period 1H, the data driver 400 outputs a red data voltage to the first source channel S1, outputs a green data voltage to the second source channel S2, and outputs a blue data voltage to the third source channel S3, for example. More specifically, the data driver 400 supplies the data voltage to the color subpixels connected to a (3m−2)-th data line, a (3m−1)-th data line, and a (3m)-th data line during the first scan period t1. The data driver 400 supplies the data voltage to the color subpixels connected to a (3(m+1)−2)-th data line, a (3(m+1)−1)-th data line, and a 3(m+1)-th data line during the second scan period t2. The data driver 400 supplies the data voltage to the color subpixels connected to a (3(m+2)−2)-th data line, a (3(m+2)−1)-th data line, and a 3(m+2)-th data line during the third scan period t3.

Namely, the data driver 400 may supply the data voltage to the red subpixel R11 of the first column line C1 and to the green subpixel G12 of the second column line C2 on the first horizontal line L1 via data lines DL2 and DL3, respectively, during the first scan period t1 of one horizontal period 1H. In this example, the first data line DL1 is not connected to a pixel on the odd-numbered horizontal lines, including the first horizontal line L1.

The data driver 400 may supply the data voltage to the blue subpixel B13 of the third column line C3, the red subpixel R14 of the fourth column line C4, and the green subpixel G15 of the fifth column line C5 on the first horizontal line L1 during the second scan period t2 of one horizontal period 1H.

The data driver 400 may supply the data voltage to the blue subpixel B16 of the sixth column line C6, the red subpixel R17 of the seventh column line C7, and the green subpixel G18 of the eighth column line C8 on the first horizontal line L1 during the third scan period t3 of one horizontal period 1H.

The data driver 400 may respectively supply the data voltages of opposite polarities to an odd-numbered source channel and an even-numbered source channel for a horizontal 1-dot inversion drive. For example, the data driver 400 may output the positive data voltage to the first source channel S1 and may output the negative data voltage to the second source channel S2.

The display device according to the first example embodiment selectively connects each source channel to the plurality of data lines and supplies the data voltage to the data lines. Thus, the display device according to the first example embodiment may supply the data voltage to the entire display panel through a number of source channels, which is lower than the number of data lines. In other words, the display device according to the first example embodiment may reduce the number of source channels of the data driver and may reduce power consumption.

In particular, because the display device according to the first example embodiment outputs the same color data voltage to each respective source channel during one horizontal period 1H, the display device according to the first example embodiment may prevent or lessen a reduction in the display quality resulting from a mixed color even when the MUX signals are delayed. This is described in detail below.

Figure 6:
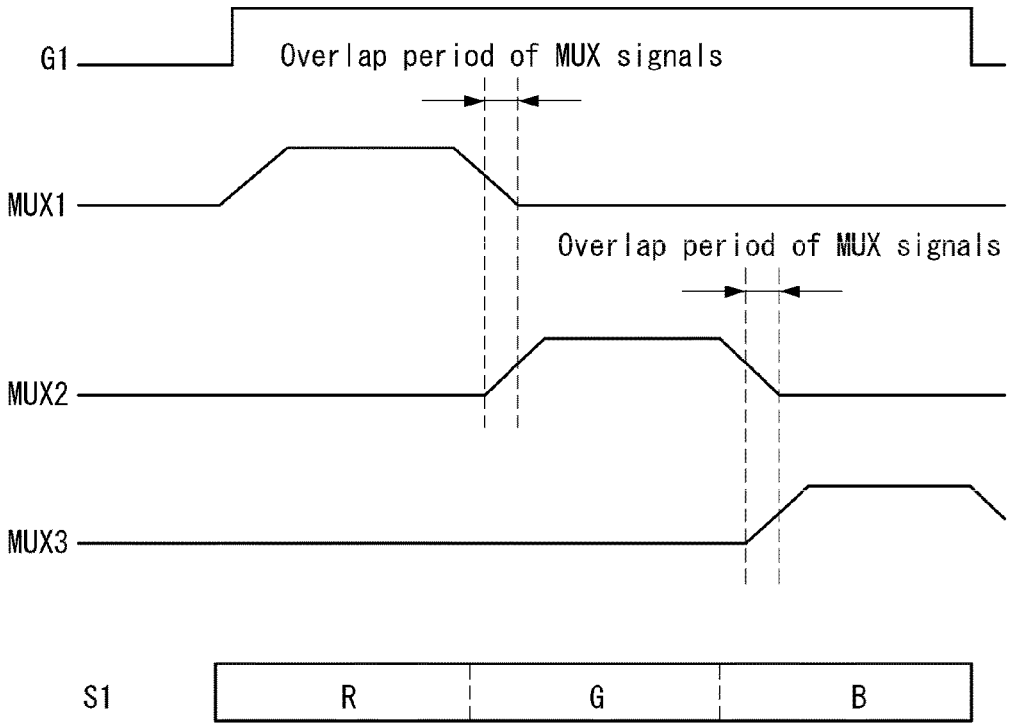
FIG. 6 shows an overlap of example MUX signals resulting from a delay of the MUX signals.

As a resolution of the display panel 100 increases, a length of each of the first to third scan periods t1 to t3 gradually decreases. Hence, an output period of each of the first to the third MUX signals MUX1 to MUX3 in the first to the third scan periods t1 to t3 decreases. As the size of the display panel 100 increases, the delay of the first to the third MUX signals MUX1 to MUX3 increases. An example waveform of the MUX signals MUX1 to MUX3 in theory is shown in FIG. 5. However, as shown in FIG. 6, a rising period and a falling period of each of the MUX signals MUX1 to MUX3 may lengthen in practice due to the delay of the MUX signals MUX1 to MUX3. Hence, an overlap between the adjacent MUX signals, for example, MUX1 and MUX2, and MUX2 and MUX3, may be generated. As a result, the data voltage output through a given source channel may undesirably be supplied to an unintended data line DL adjacent to the intended data line DL. For example, when each of the source channels S1 to Sm sequentially outputs the red data voltage, the green data voltage, and the blue data voltage, the red data voltage may be supplied to the green subpixels. When a specific color is represented, there may be a large difference between the data voltages supplied to the color subpixels. In particular, because the adjacent subpixels of the liquid crystal display may have the data voltages of opposite polarities for the horizontal 1-dot inversion drive, the display quality of the liquid crystal display may be greatly reduced when the data voltages of the different colors are mixed.

On the other hand, the display device according to the first embodiment outputs the data voltage of one color through each of the source channels S1 to Sm during one horizontal period. Because the data voltage output through each source channel is the data voltage of the adjacent subpixels of the same color, there may unlikely be a large difference between the data voltages. As a result, even if the delay of the MUX signals MUX1 to MUX3 is generated, the display device according to the first example embodiment may prevent large unintended changes in the color the subpixels represent.

Figure 7:
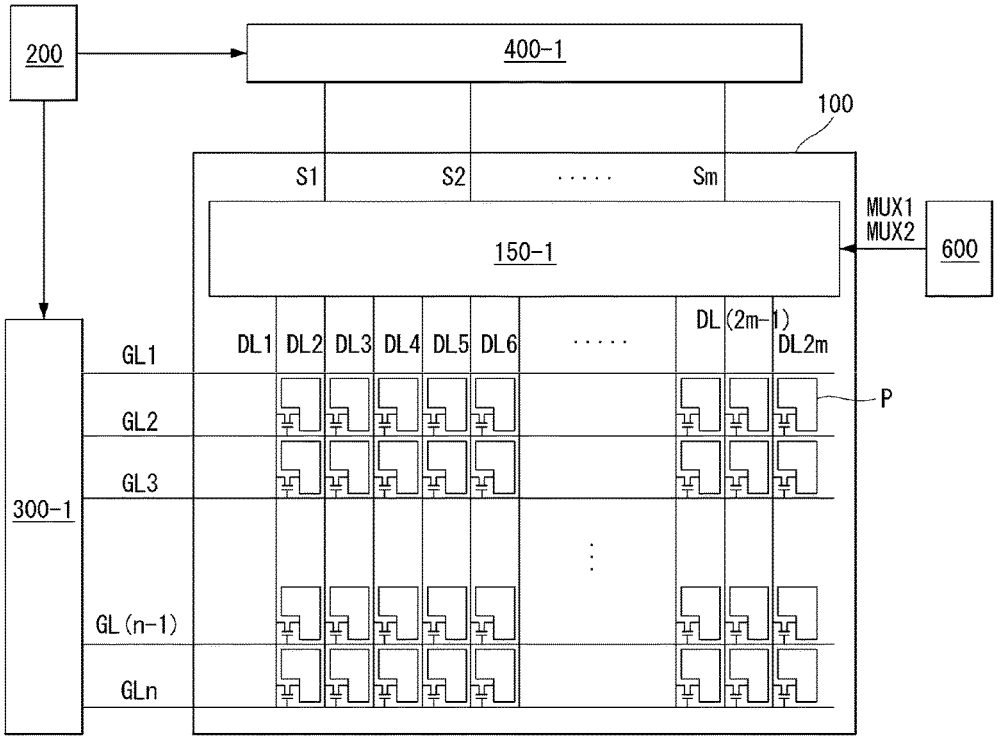
FIG. 7 illustrates a display device according to a second example embodiment of the invention.
Figure 8:
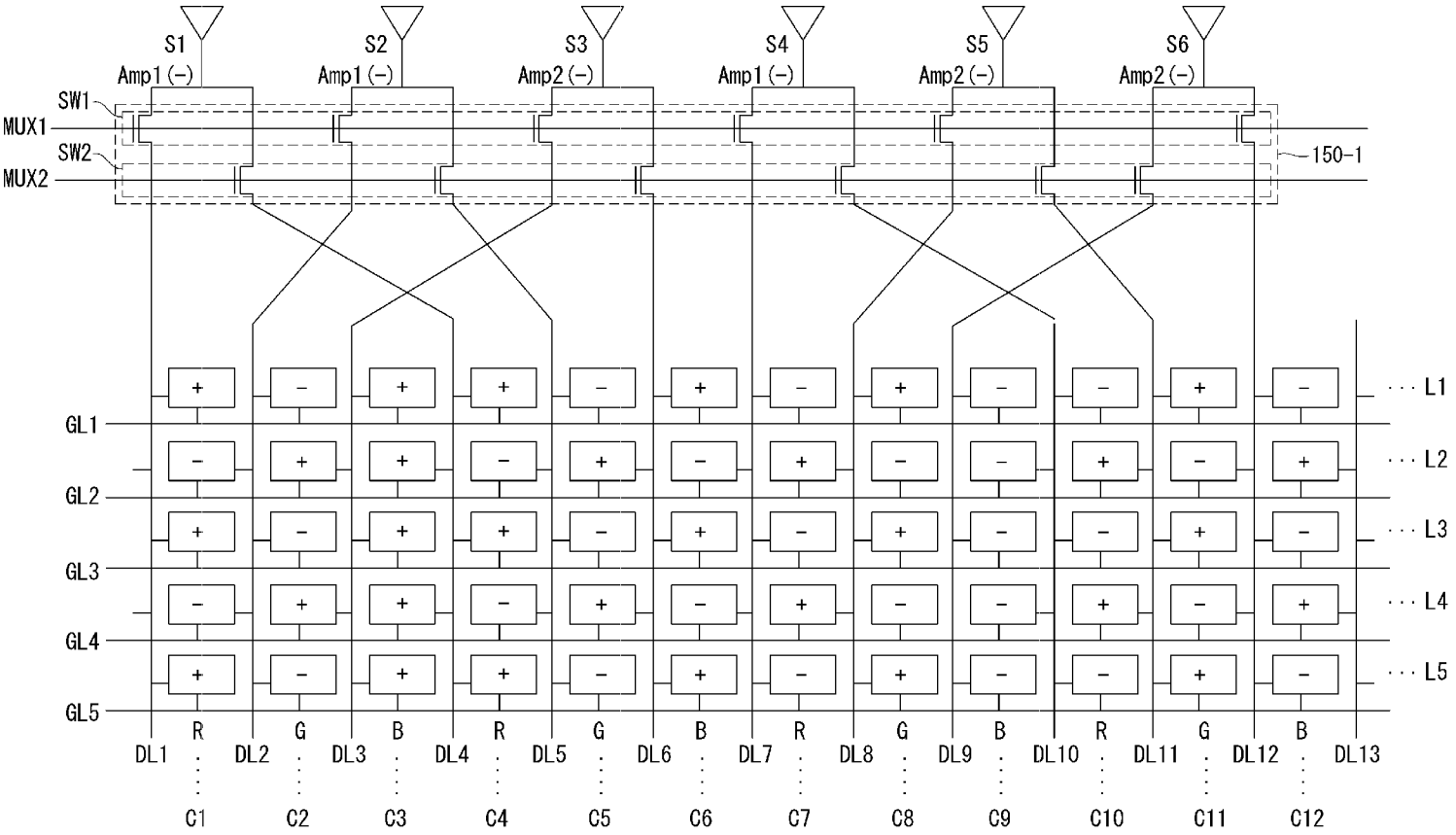
FIG. 8 illustrates a switching unit and a pixel array according to a second example embodiment of the invention.
Figure 9:
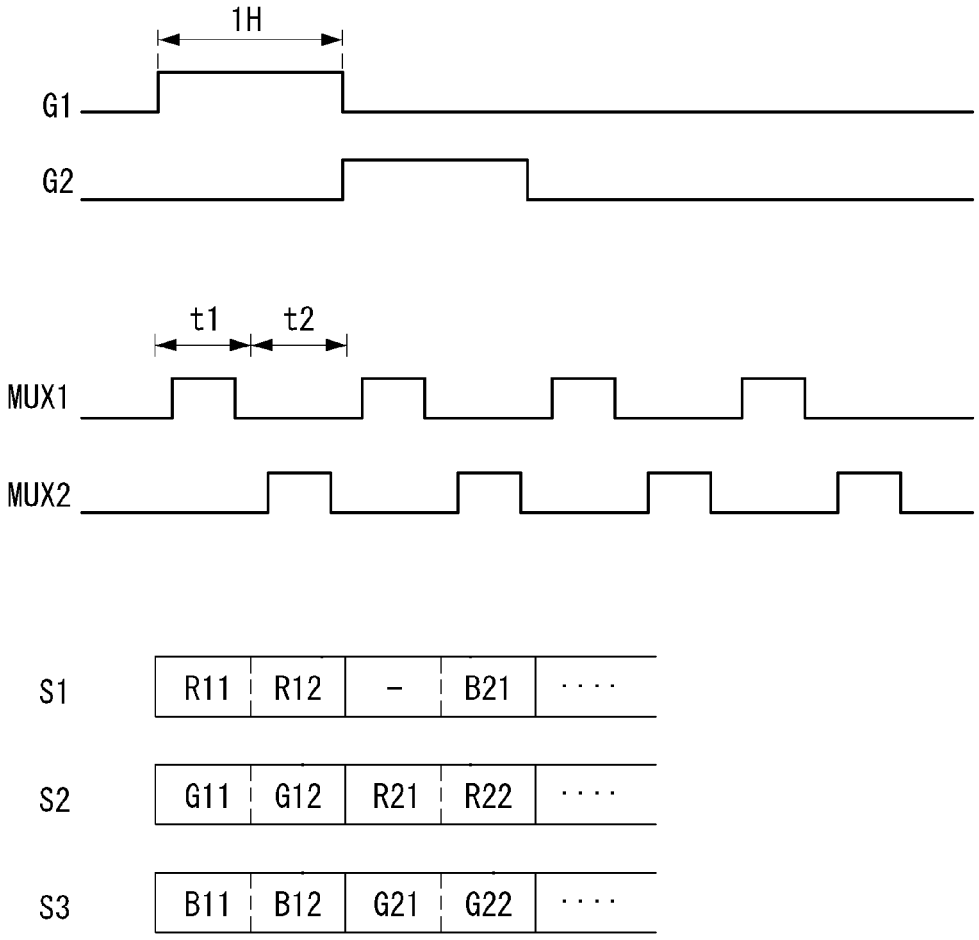
FIG. 9 shows timing of MUX signals and a gate pulse according to a second example embodiment of the invention.

FIG. 7 illustrates a display device according to a second example embodiment. FIG. 8 illustrates a switching unit and a pixel array according to the second example embodiment. FIG. 9 shows timing of MUX signals and a gate pulse according to the second example embodiment.

The display device according to the second example embodiment is described in detail below.

A display panel 100 includes red subpixels R, green subpixels G, and blue subpixels B arranged along column lines. The red subpixels R are arranged along a (3m−2)-th column line C(3m−2), where m is a natural number. The green subpixels G are arranged along a (3m−1)-th column line C(3m−1), and the blue subpixels B are arranged along a (3m)-th column line C(3m). In other words, the first to the 3m-th data lines DL1 to DL3*m* are arranged parallel to the first to the 3m-th column lines C1 to C3*m*.

The first to the 3m-th data lines DL1 to DL3*m* are disposed along a direction of the first to the 3m-th column lines C1 to C3*m*.

The first to the 3m-th data lines DL1 to DL3*m* receive a data voltage through source channels S1 to Sm used to output the data voltage through a data driver 400-1. Each of the source channels S1 to Sm is connected to the corresponding two of the data lines. A (3i−2)-th source channel is connected to a (3i−2)-th data line and a (3(i+1)−2)-th data line, where "i" is a natural number satisfying a condition of "3i=m". A (3i−1)-th source channel is connected to a (3i−1)-th data line and a (3(i+1)−1)-th data line. A (3i)-th source channel is connected to a (3i)-th data line and a 3(i+1)-th data line. For example, the first source channel S1 is connected to the first data line DL1 and the fourth data line DL4. The second source channel S2 is connected to the second data line DL2 and the fifth data line DL5. The third source channel S3 is connected to the third data line DL3 and the sixth data line DL6.

Gate lines GL may include the first to the 2n-th gate lines GL1 to GLn for supplying gate pulses during the first to the n-th horizontal periods G1 and Gn, where n is a natural number. For example, a gate driver 300-1 supplies the gate pulse to the first gate line GL1 during the first horizontal period G1, to the second gate line GL2 during the second horizontal period G2, and so on.

A switching unit 150-1 according to the second example embodiment includes the first and the second switching elements SW1 and SW2 so as to switch an output of the source channels. The first switching element SW1 operates in response to a first MUX signal MUX1, and the second switching element SW2 operates in response to a second MUX signal MUX2.

A MUX controller 600 outputs the first MUX signal MUX1 during the first scan period t1 and outputs the second MUX signal MUX2 during the second scan period t2.

During the first scan period t1, the first switching element SW1 connects the first source channel S1 to the first data line DL1, connects the second source channel S2 to the second data line DL2, and connects the third source channel S3 to the third data line DL3 in response to the first MUX signal MUX1.

During the second scan period t2, the second switching element SW2 connects the first source channel S1 to the fourth data line DL4, connects the second source channel S2 to the fifth data line DL5, and connects the third source channel S3 to the sixth data line DL6 in response to the second MUX signal MUX2.

During one horizontal period, the data driver 400-1 supplies the data voltage of the same color to each source channel. For example, during one horizontal period 1H, the data driver 400-1 outputs a red data voltage to the first source channel S1, outputs a green data voltage to the second source channel S2, and outputs a blue data voltage to the third source channel S3. More specifically, the data driver 400-1 supplies the data voltage to the color subpixels connected to a (3m−2)-th data line, a (3m−1)-th data line, and a (3m)-th data line during the first scan period t1. The data driver 400-1 supplies the data voltage to the color subpixels connected to a (3(m+1)−2)-th data line, a (3(m+1)−1)-th data line, and a 3(m+1)-th data line during the second scan period t2.

Namely, the data driver 400-1 may supply the data voltage to the red subpixel R11 of the first column line C1, the green subpixel G12 of the second column line C2, and the blue subpixel B13 of the third column line C3 on the first horizontal line L1, via data lines DL1, DL2, and DL3, respectively, during the first scan period t1 of one horizontal period 1H. In this example, the first data line DL1 is not connected to a pixel on even-numbered horizontal lines, including the second horizontal line L2.

The data driver 400-1 may supply the data voltage to the red subpixel R14 of the fourth column line C4, the green subpixel G15 of the fifth column line C5, and the blue subpixel B16 of the sixth column line C6 on the first horizontal line L1 during the second scan period t2 of one horizontal period 1H.

The data driver 400-1 may change a polarity of the data voltage output in each horizontal period.

As described above, the display device according to the second example embodiment selectively connects each source channel to the plurality of data lines and supplies the data voltage to the data lines. Thus, the display device according to the second example embodiment may supply the data voltage to the entire display panel through a number of source channels, which is lower than the number of data lines. In other words, the display device according to the second example embodiment may reduce the number of source channels of the data driver and may reduce power consumption. In particular, because the display device according to the second example embodiment outputs the same color data voltage to each respective source channel during one horizontal period 1H, the display device according to the second example embodiment may prevent or lessen a reduction in the display quality resulting from a mixed color even when the MUX signals are delayed.

Figure 10:
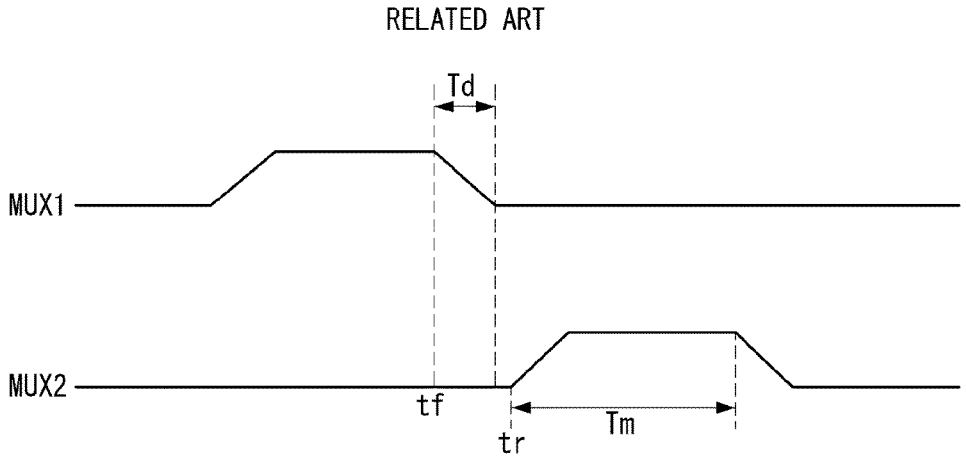
FIGS. 10 and 11 each show a timing margin period between example MUX signals.

The display quality of the display device according to the first and second example embodiments may not be significantly reduced even when the MUX signals MUX1 to MUX3 are delayed. Therefore, a shorter interval between the MUX signals MUX1 to MUX3 may be adopted without a significant reduction in the display quality. In a related art device, as shown in FIG. 10, a delay period Td of the MUX signal from a falling time point tf of the MUX signal has to be secured so as to prevent an unintended mixture of the data voltages resulting from the delay of the MUX signals MUX1 to MUX3.

Figure 11:
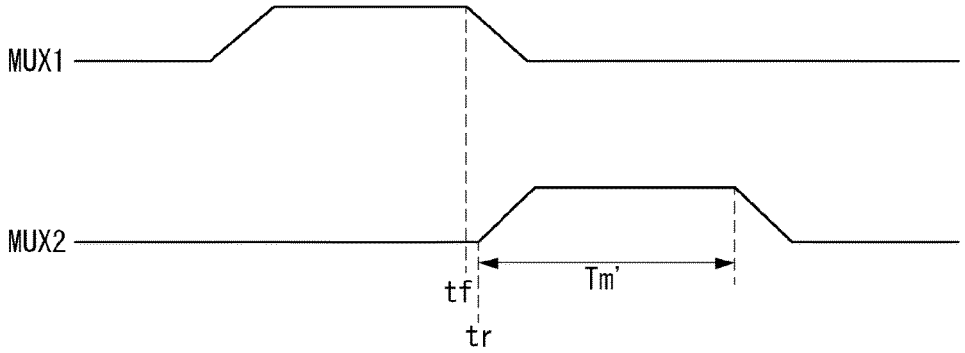

On the other hand, the display device according to the first or the second example embodiment does not necessarily need to secure a large interval between the MUX signals MUX1 to MUX3 equal to or longer than the delay period Td of the MUX, because the potential reduction in the display quality caused by the delay of the MUX signals MUX1 to MUX3 is much less significant than in the related art device. Thus, as shown FIG. 11, the display device according to the first or the second example embodiment may set a small interval between the MUX signals MUX1 to MUX3 or may remove the interval between the MUX signals MUX1 to MUX3. Because one horizontal period, in which a gate pulse is output, is determined depending on the number of horizontal lines, a length of an output period of the MUX signal may increase through a reduction in the interval between the MUX signals MUX1 to MUX3.

Accordingly, a length of an output period Tm' of the MUX signal according to the first or the second example embodiment may be longer than a length of an output period Tm of the related art MUX signal. Because the output period of the MUX signal is a period in which the pixels are charged to the data voltage, the display device according to the first or the second example embodiment may increase a data charge time. Hence, the display device according to the first and second example embodiments may be advantageously applied to a display device of a high resolution.

The example embodiments of the present invention supply the data voltage of the same color to each respective source channel during the same horizontal period and thus can prevent or lessen a reduction in the display quality even if the unintended mixture of the data voltages resulting from the delay of the MUX signals occurs.

It will be apparent to those skilled in the art that various modifications and variations can be made in the display device of the present invention without departing from the spirit or scope of the invention. Thus, it is intended that the present invention cover the modifications and variations of the disclosed and illustrated example embodiments, provided they come within the scope of the appended claims and their equivalents.

What is claimed is:

1. A display device, comprising:

a display panel including a plurality of subpixels of a plurality of colors arranged in a pixel array in a matrix form, and a plurality of gate lines and data lines respectively connected to the subpixels;

a data driver configured to supply data voltages to the subpixels through a plurality of source channels and the data lines; and a switch circuit configured to connect one of the source channels selectively to one of the data lines during a first scan period in one horizontal period and to a different one of the data lines during a second scan period in the one horizontal period, wherein the data driver is configured to supply data voltages of a same one color to the same one of the source channels during both the first scan period and the second scan period in the one horizontal period, wherein the data driver is further configured to supply a data voltage of another color different from the same one color to the same one of the source channels during a scan period in another horizontal period following the one horizontal period, wherein the switch circuit is further configured to sequentially supply data voltages output from the same one of the source channels during the one horizontal period to at least two subpixels of the same one color arranged in one horizontal line of the pixel array, and wherein the switch circuit is configured to connect the one of the source channels selectively to the one of the data lines based on a first multiplexer (MUX) signal during the first scan period and to the different one of the data lines based on a second MUX signal during the second scan period in the one horizontal period, the first MUX signal and the second MUX signal partially overlapping each other during the first scan period or the second scan period.

2. The display device of claim 1, wherein the subpixels include:

first subpixels of a first color arranged along a (3i−2)-th column line, where i is a natural number from 1 to m, m being a multiple of 3;

second subpixels of a second color arranged along a (3i−1)-th column line; and third subpixels of a third color arranged along a (3i)-th column line, and wherein the source channels include:

a (3k−2)-th source channel configured to supply a first color data voltage to the first subpixels, where k is a natural number from 1 to m/3, m/3 being a natural number;

a (3k−1)-th source channel configured to supply a second color data voltage to the second subpixels; and a (3k)-th source channel configured to supply a third color data voltage to the third subpixels.

3. The display device of claim 2, wherein the data lines include first to (3m)-th data lines respectively arranged along the first to the (3m)-th column lines, wherein the (3k−2)-th source channel is connected selectively to a (3i−2)-th data line, a (3(i+1)−2)-th data line, and a (3(i+2)−2)-th data line, wherein the (3k−1)-th source channel is connected selectively to a (3i−1)-th data line, a (3(i+1)−1)-th data line, and a (3(i+2)−1)-th data line, and wherein the (3k)-th source channel is connected selectively to a (3i)-th data line, a 3(i+1)-th data line, and a 3(i+2)-th data line.

4. The display device of claim 3, wherein the one horizontal period includes at least the first scan period, the second scan period, and a third scan period, and wherein the data driver is configured to output the data voltages selectively for the (3i−2)-th data line during the first scan period, for the (3(i+1)−2)-th data line during the second scan period, and for the (3(i+2)−2)-th data line during the third scan period.

5. The display device of claim 4, wherein the data driver is configured to supply the data voltages for the (3i−2)-th data line, the (3i−1)-th data line, and the (3i)-th data line during the first scan period, wherein the data driver is configured to supply the data voltages for the (3(i+1)−2)-th data line, the (3(i+1)−1)-th data line, and the 3(i+1)-th data line during the second scan period, and wherein the data driver is configured to supply the data voltages for the (3(i+2)−2)-th data line, the (3(i+2)−1)-th data line, and the 3(i+2)-th data line during the third scan period.

6. The display device of claim 3, wherein the switch circuit includes:

a first switch configured to connect the (3k−2)-th source channel to the (3i−2)-th data line in response to a first multiplexer (MUX) signal received during the first scan period;

a second switch configured to connect the (3k−2)-th source channel to the (3(i+1)−2)-th data line in response to a second MUX signal received during the second scan period; and a third switch configured to connect the (3k−2)-th source channel to the (3(i+2)−2)-th data line in response to a third MUX signal received during the third scan period.

7. The display device of claim 1, wherein the data driver is configured to change the color represented by the data voltages supplied to the same one of the source channels in each successive horizontal period.

8. The display device of claim 1, wherein an odd-numbered source channel and an even-numbered source channel respectively output the data voltages of different polarities.

9. The display device of claim 1, wherein the subpixels include:

first subpixels of a first color arranged along a (3i−2)-th column line, where i is a natural number from 1 to m, m being an even natural number;

second subpixels of a second color arranged along a (3i−1)-th column line; and third subpixels of a third color arranged along a (3i)-th column line, and wherein the source channels include:

a (3k−2)-th source channel configured to supply a first color data voltage to the first subpixels, where k is a natural number from 1 to m/2;

a (3k−1)-th source channel configured to supply a second color data voltage to the second subpixels; and a (3k)-th source channel configured to supply a third color data voltage to the third subpixels.

10. The display device of claim 9, wherein the data lines include first to (2m)-th data lines respectively arranged along the first to the (2m)-th column lines, wherein the (3k−2)-th source channel is connected to a (3i−2)-th data line and a (3(i+1)−2)-th data line, wherein the (3k−1)-th source channel is connected to a (3i−1)-th data line and a (3(i+1)−1)-th data line, and wherein the (3k)-th source channel is connected to a (3i)-th data line and a 3(i+1)-th data line.

11. The display device of claim 10, wherein the one horizontal period includes at least the first scan period and the second scan period, and wherein the data driver is configured to output the data voltages for the (3i−2)-th data line during the first scan period and for the (3(i+1)−2)-th data line during the second scan period.

12. The display device of claim 11, wherein the data driver is configured to supply the data voltages for the (3i−2)-th data line, the (3i−1)-th data line, and the (3i)-th data line during the first scan period, and wherein the data driver is configured to supply the data voltages for the (3(i+1)−2)-th data line, the (3(i+1)−1)-th data line, and the 3(i+1)-th data line during the second scan period.

13. The display device of claim 10, wherein the switching unit includes:

a first switch configured to connect the (3k−2)-th source channel to the (3i−2)-th data line in response to a first MUX signal received during the first scan period; and a second switch configured to connect the (3k−2)-th source channel to the (3(i+1)−2)-th data line in response to a second MUX signal received during the second scan period.

14. The display device of claim 1, wherein only one of the gate lines is activated during the one horizontal period.

15. The display device of claim 1, wherein the one of the data lines is connected to subpixels of an even-numbered column line arranged on an odd-numbered horizontal line and to subpixels of an odd-numbered column line on an even-numbered horizontal line, or is connected to subpixels of an odd-numbered column line arranged on an odd-numbered horizontal line and to subpixels of an even-numbered column line on an even-numbered horizontal line.

16. A display device, comprising:

a plurality of subpixels in a pixel array arranged in a matrix form, including:

a first subpixel group including a first subpixel of a first color, a second subpixel of a second color, and a third subpixel of a third color; and a second subpixel group including a fourth subpixel of the first color, a fifth subpixel of the second color, and a sixth subpixel of the third color;

a plurality of data lines and a plurality of gate lines, the data lines including at least first to sixth data lines respectively connected to the first to the sixth subpixels, the first data line being connected to the first subpixel and the fourth data line being connected to the fourth subpixel, and the gate lines including at least a first gate line connected to each of the first to the sixth subpixels; a data driver configured to supply data voltages respectively to a plurality of source channels including at least a first source channel, a second source channel, and a third source channel; and a switch circuit configured to selectively connect the first source channel at least to the first data line and the fourth data line, the second source channel at least to the second data line and the fifth data line, and the third source channel at least to the third data line and the sixth data line, wherein at least one of the first to the sixth data lines is connected to subpixels of an even-numbered column line arranged on an odd-numbered horizontal line and to subpixels of an odd-numbered column line on an even-numbered horizontal line, or is connected to subpixels of an odd-numbered column line arranged on an odd-numbered horizontal line and to subpixels of an even-numbered column line on an even-numbered horizontal line, wherein the switch circuit is further configured to sequentially supply data voltages output from a same one of the source channels during one horizontal period to at least two subpixels of a same one color arranged in one horizontal line of the pixel array, and wherein the switch circuit is configured to provide to the data driver a first multiplexer (MUX) signal during a first scan period in one horizontal period and a second MUX signal during a second scan period in the one horizontal period to selectively connect the first source channel to the first data line in response to the first MUX signal and to the fourth data line in response to the second MUX signal, to selectively connect the second source channel to the second data line in response to the first MUX signal and to the fifth data line in response to the second MUX signal, and to selectively connect the third source channel to the third data line in response to the first MUX signal and to the sixth data line in response to the second MUX signal, the first MUX signal and the second MUX signal partially overlapping each other during the first scan period or the second scan period.

17. The display device of claim 16, wherein the data driver is configured to supply the data voltages to the first source channel, the second source channel, and the third source channel, respectively, in each of at least first and second scan periods during one horizontal period in which the first gate line is activated.

18. The display device of claim 17, wherein the switch circuit includes:

a plurality of first switches configured to connect the first source channel to the first data line, the second source channel to the second data line, and the third source channel to the third data line, respectively, in response to a first MUX signal during the first scan period, and a plurality of second switches configured to connect the first source channel to the fourth data line, the second source channel to the fifth data line, and the third source channel to the sixth data line, respectively, in response to a second MUX signal during the second scan period.

19. The display device of claim 16, further comprising:

a third subpixel group including a seventh subpixel of the first color, an eighth subpixel of the second color, and a ninth subpixel of the third color, wherein the first gate line is connected to each of the seventh to the ninth subpixels, wherein the data lines include a seventh data line connected to the seventh subpixel, an eighth data line connected to the eighth subpixel, and a ninth data line connected to the ninth subpixel, and wherein the switch circuit is configured to selectively connect the first source channel at least to the first data line, the fourth data line, and the seventh data line, the second source channel at least to the second data line, the fifth data line, and the eighth data line, and the third source channel at least to the third data line, the sixth data line, and the ninth data line.

20. The display device of claim 19, wherein the data driver is configured to supply the data voltages to the first source channel, the second source channel, and the third source channel, respectively, in each of at least first, second, and third scan periods during one horizontal period in which the first gate line is activated.

21. The display device of claim 20, wherein the switch circuit includes:

a plurality of first switches configured to connect the first source channel to the first data line, the second source channel to the second data line, and the third source channel to the third data line, respectively, in response to a first MUX signal during the first scan period, a plurality of second switches configured to connect the first source channel to the fourth data line, the second source channel to the fifth data line, and the third source channel to the sixth data line, respectively, in response to a second MUX signal during the second scan period, and a plurality of third switches configured to connect the first source channel to the seventh data line, the second source channel to the eighth data line, and the third source channel to the ninth data line, respectively, in response to a third MUX signal during the third scan period.

* * * * *